United States Patent [19]

Colgate

[11] Patent Number: 4,488,024

[45] Date of Patent: Dec. 11, 1984

[54] WALL SWITCH COVER AND ACTUATOR

[75] Inventor: Samuel O. Colgate, Gainesville, Fla.

[73] Assignee: Frederick M. Butler, Jr., Gainesville, Fla.

[21] Appl. No.: 504,896

[22] Filed: Jun. 16, 1983

[51] Int. Cl.[3] ..... H01H 3/00

[52] U.S. Cl. ..... 200/330

[58] Field of Search ..... 200/330, 331, 333, 338, 200/302

[56] References Cited

U.S. PATENT DOCUMENTS

| | | | |
|---|---|---|---|
| 1,989,393 | 1/1935 | Anderson | 200/330 |
| 3,217,112 | 11/1965 | Campbell et al. | 200/339 |
| 3,668,938 | 6/1972 | Dimitry | 200/333 |
| 3,932,721 | 1/1976 | Crowell et al. | 200/333 |

*Primary Examiner*—John W. Shepperd

*Attorney, Agent, or Firm*—Duckworth, Allen, Dyer & Pettis

[57] ABSTRACT

A wall switch cover and actuator of the type used in combination with a standard wall toggle switch whereby operation of the switch between its on and off positions is accomplished by pressing on the face of the invention. The wall switch cover and actuator basically comprises a frame which is held in position over the standard switch by the switch's cover plate. A switch actuator element is removably held within the frame, and portions of the switch actuator abut opposite sides of the standard toggle switch. A cover is also mounted on the frame over the switch actuator so that pressure on the cover will be transmitted through the switch actuator to operate the toggle switch.

11 Claims, 9 Drawing Figures

WALL SWITCH COVER AND ACTUATOR

BACKGROUND OF THE INVENTION

1. Field of the Invention

The present invention relates to a wall switch cover and actuator intended for use in combination with a standard wall toggle switch. The cover and actuator of this invention is characterized by the fact that it may be attached to a standard wall switch very simply, and such installation does not require any electrical connections. The invention is further characterized by its simplicity of operation, its uncluttered appearance when installed, and the ease with which it adapts to suit the user individual decorating taste.

2. Description of the Prior Art

Since the wall switch cover and actuator of this invention is intended for use in combination with a standard wall toggle switch, it is to be understood that such standard switch constructions constitute relevant prior art, but are not included within the scope of the claimed invention. Furthermore, since such prior art switches are literally universal in their use in both commercial and residential installations, it is not surprising to find numerous prior art devices intended for use in combination with such switches and having as a stated purpose not only enhancing the switch's appearance, but also improving its mode of operation. It is also to be observed that wall switches of a "push-type" construction are known wherein the switch is moved between its on and off positions by "pushing" a switch plate rather than flipping a toggle. Such push-type switches are considered to be part of the relevant prior art, and are clearly distinguishable from the present invention. As already stated, and as will be set forth in greater detail hereinafter, the present invention is used in combination with a toggle switch. Furthermore, unlike state-of-the-art push-type switches, the switch cover and actuator of this invention requires no electrical connection of any sort. The following U.S. patents all relate to various constructions of auxilliary devices used in combination with standard wall switches either for altering their mode of operation, or for enhancing their aesthetic appearance:

| | |
|---|---|
| 2,285,561 | 2,382,738 |
| 2,712,582 | 3,004,128 |
| 3,028,467 | 3,188,438 |
| 3,839,615 | 3,892,935 |
| 4,105,884 | 4,234,774 |

While each of the above prior art devices is certainly useful and operable in accord with its disclosure, even a brief review of the disclosed constructions reveals that none of these prior art devices provides the novel and useful features of the present invention. In fact, most of these devices teach an extension to, or appendage for, the standard toggle lever.

It is therefore clear that there is a great need in the art for a wall switch cover and actuator of simple construction and operation whereby a standard wall switch may be converted from toggle to touch-type operation. Preferably, such a cover and actuator would be easily installed, requiring no modification of the existing toggle switch and should present, in its installed position, a clean, enclosed appearance suitable for interior decoration in accord with the user's personal desires.

SUMMARY OF THE INVENTION

The wall switch cover and actuator of this invention is primarily intended for use in combination with a standard wall toggle switch for the purpose of converting such a standard switch to a touch-type operation and for the further purpose of presenting an exterior appearance which may be easily incorporated into the user's interior design scheme. The cover and actuator of this invention is perhaps most noteworthy for its relatively simple construction and the ease with which it may be operatively attached to the standard wall switch, requiring no electrical connections.

While a preferred construction for the cover and actuator of this invention will be set forth in detail hereinafter, its construction includes three basic elements. The cover and actuator first comprises a frame member defined by a base plate having an aperture formed therein. The size of this aperture is slightly less than the perimeter of the switch's cover plate, so that the frame member is held in operative position over the switch by simply removing the switch cover plate, positioning the frame member against the wall, and replacing the switch cover plate in normal fashion. The frame member further comprises opposed first and second frame side walls extending transversely from the base plate and opposed top and bottom frame lips also extending from the base plate in transverse relation between the first and second side walls.

A switch actuator means is removably mounted within the frame member and is held therein by engaging corresponding top and bottom portions of the switch actuator means with the top and bottom frame lips. As is described in greater detail below, the switch actuator means is formed from a flexible material and further comprises first and second toggle fingers formed thereon, with each of those fingers being dimensioned and configured to engage a corresponding first and second surface of the toggle arm used to operate the wall switch.

Finally, the construction of this cover and actuator requires a cover sheet which is removably mounted onto the frame member and held therein by the top and bottom frame lips. This cover sheet is also formed from a flexible material and, when properly installed, lies over the switch actuator means. Thus, when all three elements of the cover and actuator of this invention are assembled in combination with a standard wall toggle switch, pressure applied to the flexible cover sheet will be transferred through the actuator means causing one of the toggle fingers to move the toggle arm from its initial position to its second position. Clearly, then, a second application of pressure to the cover sheet would cause the other toggle finger to bear against the toggle arm, returning it to its initial position. Thus, by virtue of this construction a standard wall toggle switch may be operated in a touch-type fashion.

It is also to be noted that the flexible cover sheet may be formed from a decorative material which corresponds to the interior design of the space in which the cover and actuator is being installed. Alternatively, the cover sheet may be formed from a transparent material, and a decorative insert may be interposed between the cover sheet and the actuator means. This construction, utilizing a transparent cover sheet and a separate decorative insert would permit rapid and virtually unlimited changing of the invention's outward appearance. Finally, actual use of the cover and actuator of this invention indicates that it may be desirable to provide a reinforcing insert either between the cover sheet and the actuator means, or between the decorative insert and the actuator means. With regard to both the decorative insert and the reinforcing insert it is to be understood that both are formed from a flexible material and are held within the frame member just as are the actuator means and the cover sheet. That is to say, end portions of the decorative insert and/or the reinforcing insert are held by the top and bottom frame lips formed on the frame member.

According to a second embodiment, the switch actuator means is formed from a strip of resilient material removably mounted within the frame member as above. A toggle aperture is formed through the strip, and the toggle arm extends therethrough. Thus, the first and second toggle fingers of this second embodiment are defined by opposed semicircles of the toggle aperture.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
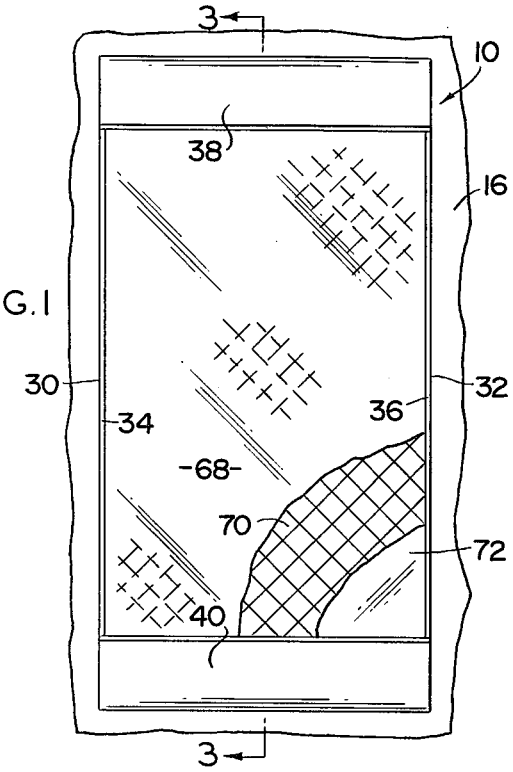
FIG. 1 is a front elevational view showing an operative installation of the cover and actuator of this invention, partially in section to illustrate interior detail.
Figure 2:
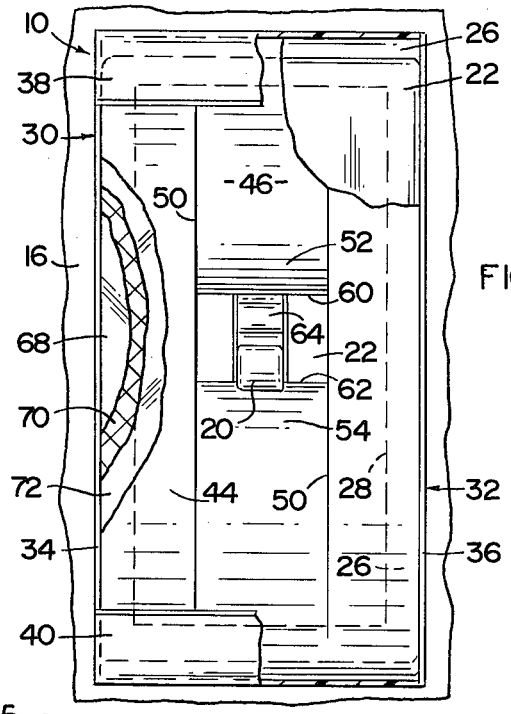
FIG. 2 is a front elevational view of the device shown in FIG. 1 illustrating further interior details.

The wall switch cover actuator of this invention is generally indicated as 10 and is shown in the view of FIGS. 1, 2, and a in its normal, operative installation in combination with a standard wall toggle switch, generally indicated as 12. Referring first to those drawing figures, it can be seen that the cover and actuator 12 is mounted in substantially surrounding, enclosing relation to wall switch 12, which is, in turn, mounted in switch aperture 14 formed through wall 16. Though not forming a part of this invention, per se, wall toggle switch 12 is of standard construction and includes a switch box 18, a toggle arm 20, and a switch cover plate 22 held in position as by screws 24.

Figure 3:
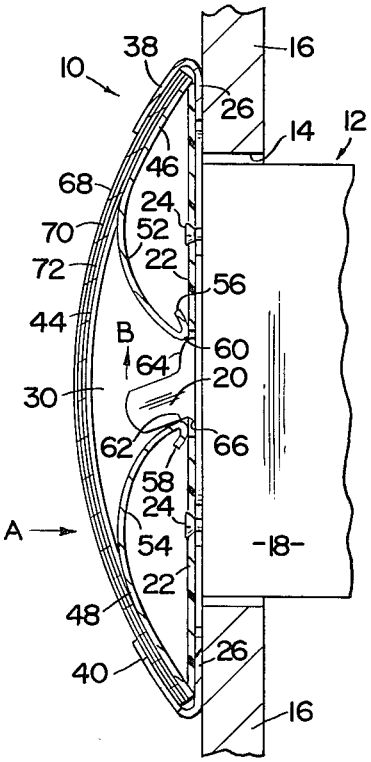
FIG. 3 is a sectional view taken along line 3—3 of FIG. 1.
Figure 4:
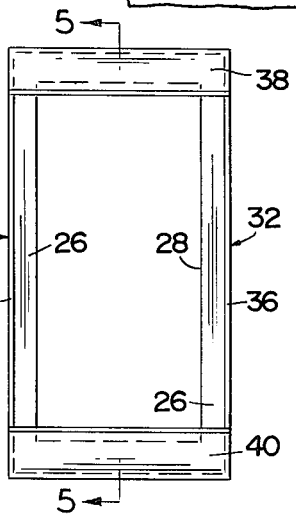
FIG. 4 is a plan view of the frame member.
Figure 5:
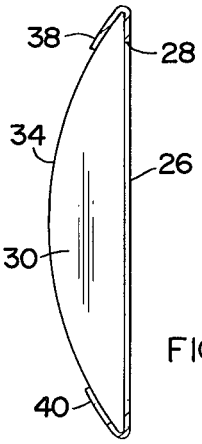
FIG. 5 is a sectional view taken along line 5—5 of FIG. 4.

As perhaps best seen in the views of FIGS. 3, 4 and 5, cover and actuator 10 comprises a frame member defined by a base plate 26 having an aperture 28 formed therein. Opposed first and second frame side walls 30 and 32, respectively, extend transversely from base plate 26 and each define corresponding first and second arcuate top edges 34 and 36, respectively. Finally, the frame member further comprises opposed top and bottom frame lips 38 and 40 extending from base plate 26 in transverse relation between first side wall 30 and second side wall 32. As perhaps best seen in the view of FIG. 5, top frame lip 38 and bottom frame lip 40 are substantially congruent with their corresponding segments of top edges 34 and 36. It is by virtue of this construction of the frame member that the cover and actuator 10 may be operatively installed simply by first removing screws 24 and switch cover plate 22. The frame member is then put into position and switch cover plate 22 is attached normally with its screws 24. Since the perimeter of switch cover plate 22 is larger than aperture 28 formed through base plate 26, the frame member is held securely against wall 16 and wall switch 12.

Figure 6:
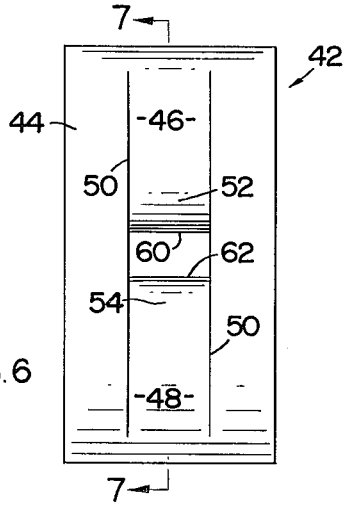
FIG. 6 is a plan view of the switch actuator means.
Figure 7:
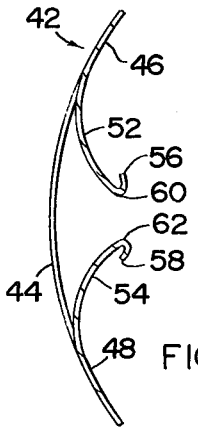
FIG. 7 is sectional view taken along line 7—7 of FIG. 6.

Wall switch cover and actuator 10 further comprises the switch actuator means generally indicated as 42 in the views of FIGS. 6 and 7. Switch actuator means 42 is formed from flexible sheet material and comprises a main body 44 dimensioned and configured to fit within top frame lip 38 and bottom frame lip 40 to define an arcuate top surface corresponding substantially to the curved surface defined by first and second top edges 34 and 36. The switch actuator means 42 further comprises a first toggle finger 46 and a second toggle finger 48 defined by a pair of substantially parallel longitudinal slits 50 formed through main body 44 and a substantially bisecting transverse slit intersecting the pair of longitudinal slits 50. As most clearly seen in the views of FIGS. 3 and 7, a segment 52 of first toggle finger 46 and a corresponding segment 54 of second toggle finger 48 are each deformed downwardly with respect to the arcuate top surface of main body 44 in the direction of toggle arm 20. Finally, as best seen in the view of FIG. 7, distal end 56 of first finger 46 is turned back upon itself to define a first shoulder 60. In similar fashion, distal end 58 of second finger 48 is turned back upon itself to define a second shoulder 62. When operatively installed, as seen in the view of FIG. 3, first shoulder 60 and second shoulder 62 actually define corresponding first and second cam surfaces with respect to first surface 64 and second surface 66 of toggle arm 20.

The last of the three primary elements of cover and actuator 10 comprises cover sheet 68 which is removably held within the frame member by top frame lip 38 and bottom frame lip 40. It is, of course, the purpose of cover sheet 68 to enclose the front of wall switch cover and actuator 10 so as to present a finished, attractive appearance. Accordingly, cover sheet 68 may be formed from a flexible decorative material in accord with the user's desires. Alternatively, and as is illustrated in the preferred construction shown in the drawing figures, cover and actuator 10 utilizes a cover sheet 68 formed from a flexible, transparent material. Placed immediately behind cover sheet 68 is a decorative insert 70 which would therefore be visible through cover sheet 68. Then, primarily for purposes of strength and durability, the preferred cover and actuator 10 also comprises a reinforcing insert 72 similarly mounted within the frame member and interposed between decorative insert 70 and main body 44 of the switch actuator means 42. At this point it is to be noted that there is no intention to limit the present invention in a fashion requiring the presence of either decorative insert 70 or reinforcing insert 72. These elements are considered desirable, but are clearly not necessary to the function of cover and actuator 10. That is to say, either or both of the decorative insert 70 and the reinforcing insert 72 could be omitted.

Figure 9:
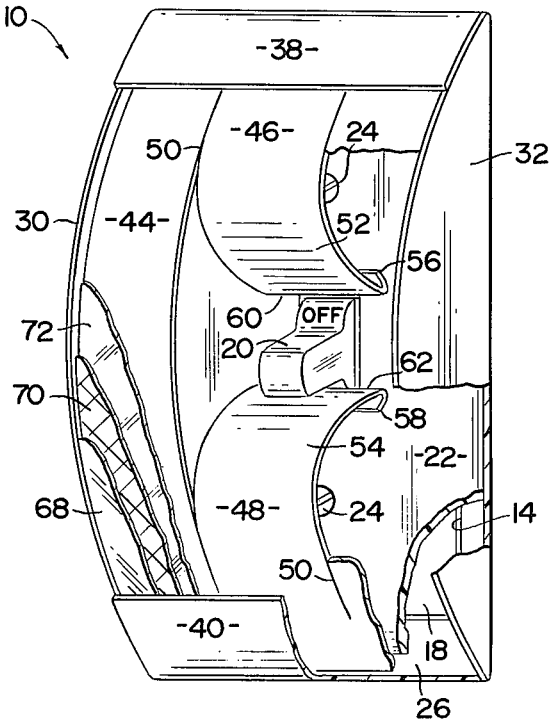
FIG. 9 is a perspective view, partially in section, similar to the view of FIG. 1.

Having thus set forth a preferred construction for wall switch cover and actuator 10, and with specific regard to the view of FIGS. 3 and 9, it can be seen that with toggle arm 20 in the position shown ("off"), application of pressure to cover sheet 68 as indicated by directional arrow A will result in a transfer of that force from cover sheet 68 through decorative insert 70 and reinforcing insert 72 to switch actuator means 42. This will result in the application of pressure through second shoulder 62 against second surface 66 of toggle arm 20 causing it to move upwardly ("on"), as indicated by directional arrow B.

Repeated tests of the prototype model have confirmed not only the ease of installation and operation, but also long life characteristics for cover and actuator 10. The ease of installation is immediately perceived from the description already given above. Furthermore, since all structural elements other than the frame member are formed from flexible material, they are quite easily inserted, removed and changed as desired. Ease of operation is similarly apparent from the brief description just given. The long life of cover and actuator 10 is attributed to its construction having no involved mechanical components and the preferred fabrication of its elements from plastic materials. First and second shoulder 60 and 62 serve to move toggle arm 20 and thereby operate switch twelve with ease because there is very little friction resistance between shoulders 60 and 62 and those segments of switch cover plate 22 and toggle arm 20 against which they bear. It is, of course, to be understood that while segment 52 of first toggle finger 46 and corresponding segment 54 of second toggle finger 48 are permanently deformed as illustrated in FIGS. 3, 6 and 7, their flexibility and bias are retained. Thus, segments 52 and 54 actually respond much like "springs" to pressure applied against the face of cover sheet 68.

Figure 8:
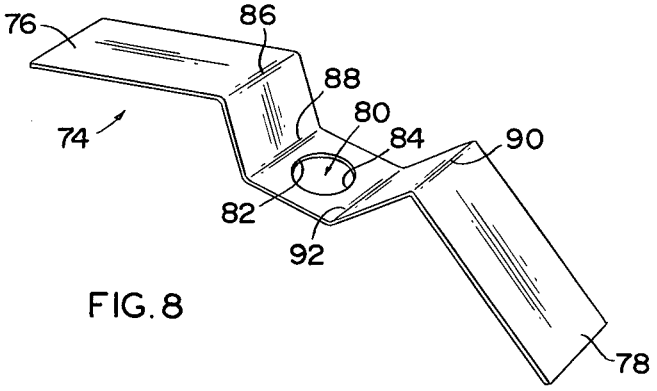
FIG. 8 is a perspective view of a second embodiment of the switch actuator means.

A second embodiment for the switch actuator means of this invention is generally indicated as 74 in the view of FIG. 8. As can be seen in that drawing, the width of the switch actuator means second embodiment 74 is substantially less than that of the preferred embodiment; however, its installation and operation is substantially equivalent. Second embodiment 74 of the switch actuator means is formed from flexible material having "memory" characteristics, and defines a first end 76 and a second end 78. Installation of second embodiment 74 is accomplished by inserting first end 76 within top frame lip 38 and inserting second end 78 within bottom frame lip 40. A toggle aperture 80 is formed substantially through the midpoint of second switch actuator means 74 such that toggle arm 20 may extend therethrough. Thus, in the second embodiment 74 a first operating surface is defined by first semicircle 82, and a second operating surface is defined by second semicircular segment 84. It is to be understood that first semicircular segment 82 is equivalent in function to first shoulder 60 and that second semicircular segment 84 is equivalent in function to second shoulder 62 of the preferred embodiment.

Still with regard to the view of FIG. 8, it can be seen that second embodiment 74 of the switch actuator means further comprises a first fold 86 in spaced apart relation to first end 76 and a second fold 88 intermediate first fold 86 and first semicircular segment 82. In corresponding fashion second embodiment 74 further comprises a third fold 90 in spaced apart relation to second end 78 and a fourth fold 92 interposed between third fold 90 and second semicircular segment 84. Because of the "memory" characteristics of the flexible material from which second embodiment 74 is formed, it may be substituted for switch actuator means 42 as, for example, in the operative installation depicted in the views of FIGS. 3 and 9. It is also to be noted that the angles defined at first fold 86 and third fold 90 are preferably greater than 90 so as to permit proper operation of the invention and to eliminate substantially the likelihood of second embodiment 74 collapsing upon itself.

It will thus be seen that the objects set forth above, among those made apparent from the preceeding description, are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A wall switch cover and actuator of the type primarily intended for use in combination with a standard wall toggle switch, said cover and actuator comprising: a frame member defined by a base plate having an aperture formed therein whereby said frame member may be mounted over the wall switch and held thereon by the wall switch cover plate, opposed first and second frame side walls extending transversely from said base plate, and opposed top and bottom frame lips extending from said base plate in transverse relation between said first and second side walls; a switch actuator means removably held by said top and bottom frame lips within said frame member said switch actuator means comprising first and second toggle fingers formed thereon, each of said fingers being dimensioned and configured to engage a corresponding first and second surface of the toggle arm used to operate the wall switch; and a cover sheet removably held by said top and bottom frame lips within said frame member in juxtaposition to said switch actuator means, both said switch actuator means and said cover sheet being bowed and formed from a resilient material, whereby pressure applied to said cover sheet will be transferred through said actuator means to move the wall switch toggle arm.

2. A wall switch cover and actuator as in claim 1 wherein said first and second frame side walls each define corresponding first and second arcuate top edges, and wherein said top and bottom frame lips are each substantially congruent with its corresponding segment of said top edges.

3. A wall switch cover and actuator as in claim 2 wherein said switch actuator means is dimensioned and configured to fit within said top and bottom frame lips and when so placed to define an arcuate top surface corresponding substantially to the curved surface defined by said first and second arcuate top edges.

4. A wall switch cover and actuator as in claim 3 wherein said first and second toggle fingers are defined by a pair of substantially parallel longitudinal slits formed through said switch actuator means and a substantially bisecting transverse slit intersecting said pair of longitudinal slits, each of said first and second toggle fingers formed thereby being deformed downwardly with respect to said arcuate top surface, whereby the distal end of each of said fingers formed by said transverse slit will engage a corresponding one of the first and second surfaces of the toggle arm.

5. A wall switch and actuator as in claim 4 wherein each of said first and second finger distal ends comprises a shoulder formed by deforming a segment of said distal ends back upon itself, whereby said shoulders define corresponding first and second cam surfaces with respect to the first and second surfaces of the toggle arm.

6. A wall switch cover and actuator as in claim 1 further comprising a decorative insert formed from a flexible material and removably held by said top and bottom frame lips within said frame member in juxtaposition between said switch actuator means and said cover sheet, said cover sheet being formed from a transparent material whereby said decorative insert is visible.

7. A wall switch cover and actuator as in claim 6 further comprising a reinforcing insert formed from a flexible material and removably held by said top and bottom frame lips within said frame member in juxtaposition between said switch actuator means and said decorative insert.

8. A wall switch cover and actuator as in claim 1 further comprising a reinforcing insert formed from a flexible material and removably held by said top and bottom frame lips within said frame member in juxtaposition between said switch actuator means and said cover sheet.

9. A wall switch cover and actuator as in claim 8 further comprising a decorative insert formed from a flexible material and removably held by said top and bottom frame lips within said frame member in juxtaposition between said reinforcing insert and said cover sheet, said cover sheet being formed from a transparent material whereby said decorative insert is visible.

10. A wall switch cover and actuator of the type primarily intended for use in combination with a standard wall toggle switch, said cover and actuator comprising: a frame member defined by a base plate having an aperture formed therein whereby said frame member may be mounted over the wall switch and held thereon by the wall switch cover plate, opposed first and second frame side walls extending transversely from said base plate, and opposed top and bottom frame lips extending from said base plate in transverse relation between said first and second side walls, said first and second frame side walls each defining corresponding first and second arcuate top edges, and said top and bottom frame lips each being substantially congruent with its corresponding segment of said top edges; a switch actuator means removably held by said top and bottom frame lips within said frame member, said switch actuator means comprising a first end and a second end and being dimensioned and configured to fit within said top and bottom frame lips, said switch actuator means further comprising a toggle aperture formed through its mid point, whereby the wall switch toggle arm may extend through said toggle aperture, said toggle aperture being defined by corresponding opposed first and second semicircular segments of its perimeter, whereby said first and second segments will engage corresponding first and second surfaces of the toggle arm used to operate the wall switch; and cover sheet removably held by said top and bottom frame lips within said frame member in juxtaposition to said switch actuator means, both said switch actuator means and said cover sheet having bowed and formed from a resilient material, whereby pressure applied to said cover sheet will be transferred through said actuator means to move the wall switch toggle arm.

11. A wall switch cover and actuator as in claim 10 wherein said switch actuator means further comprises a first fold intermediate said first end and said first segment; a second fold intermediate said first fold and said first segment; a third fold intermediate said second end and said second segment; and a fourth fold intermediate said thrid fold and said second segment, each of said folds being transverse with respect to the longitudinal dimension of said switch actuator means and further being substantially parallel to the others.

* * * * *